US009746006B2

(12) United States Patent
Ishibashi et al.

(10) Patent No.: US 9,746,006 B2
(45) Date of Patent: Aug. 29, 2017

(54) FLUID PRESSURE CYLINDER

(71) Applicant: SMC Kabushiki Kaisha, Chiyoda-ku (JP)

(72) Inventors: Koichiro Ishibashi, Tsukubamirai (JP); Koji Hara, Tsukubamirai (JP); Toshio Sato, Tsukuba (JP)

(73) Assignee: SMC KABUSHIKI KAISHA, Chiyoda-ku (JP)

( * ) Notice: Subject to any disclaimer, the term of this patent is extended or adjusted under 35 U.S.C. 154(b) by 594 days.

(21) Appl. No.: 13/900,689

(22) Filed: May 23, 2013

(65) Prior Publication Data

US 2013/0336827 A1 Dec. 19, 2013

(30) Foreign Application Priority Data

Jun. 18, 2012 (JP) ..... 2012-136776

(51) Int. Cl.
*F15B 15/14* (2006.01)

(52) U.S. Cl.
CPC ..... *F15B 15/14* (2013.01); *F15B 15/1438* (2013.01); *F15B 15/1447* (2013.01)

(58) Field of Classification Search
CPC .... F16J 12/00; F15B 15/1433; F15B 15/1438
USPC ..... 92/169.1
See application file for complete search history.

(56) References Cited

U.S. PATENT DOCUMENTS 414,460 A * 11/1889 Thurston ..... F16J 10/02 92/163
1,360,043 A * 11/1920 Stankoff ..... F01B 31/08 92/169.1
1,801,006 A * 4/1931 Jacoby ..... B23P 11/005 138/89
2,952,400 A * 9/1960 Hintze ..... F25B 31/00 417/321
3,120,338 A * 2/1964 Rhodes ..... F04B 27/02 417/415
3,786,730 A * 1/1974 Linderholm ..... B21D 39/00 29/512
4,924,758 A * 5/1990 Yuda ..... F01B 11/02 92/169.1

(Continued)

FOREIGN PATENT DOCUMENTS

| | | |
|---|---|---|
| JP | 2005-240936 | 9/2005 |
| JP | 2011-214697 | 10/2011 |
| WO | WO 2009/060707 | 5/2009 |

OTHER PUBLICATIONS

Japanese Office Action dated Feb. 16, 2016 in Japanese Patent Application No. 2012-136776 w/English translation.

*Primary Examiner* — Michael Leslie
*Assistant Examiner* — Matthew Wiblin
(74) *Attorney, Agent, or Firm* — Oblon, McClelland, Maier & Neustadt, L.L.P.

(57) ABSTRACT

An open end of a cylinder main body is blocked by a cap, which includes a main body portion, and an outer edge portion that bends from the main body portion toward the open end of the cylinder main body, a distal end of the outer edge portion being locked with an inner circumferential wall. When a piston comes into abutment against the main body portion, a space is formed by the outer edge portion, the inner circumferential wall, and the end surface of the piston. A first port is disposed so as to communicate with the space, whereby the space serves as a space into which the pressure fluid is introduced.

4 Claims, 11 Drawing Sheets

(56) References Cited

U.S. PATENT DOCUMENTS

| | | | | |
|---|---|---|---|---|
| 6,520,065 | B2 * | 2/2003 | Sakurai | F15B 15/1428 92/169.1 |
| 2011/0240649 | A1 * | 10/2011 | Hara | F15B 15/1438 220/324 |

* cited by examiner

FLUID PRESSURE CYLINDER

CROSS-REFERENCE TO RELATED APPLICATION

This application is based upon and claims the benefit of priority from Japanese Patent Application No. 2012-136776 filed on Jun. 18, 2012, the contents of which are incorporated herein by reference.

BACKGROUND OF THE INVENTION

Field of the Invention

The present invention relates to a fluid pressure cylinder which causes a piston to be displaced along axial directions under the action of a pressure fluid.

Description of the Related Art

Heretofore, a fluid pressure cylinder has been used as a means for driving various types of industrial machines such as workpiece transport and positioning devices or the like.

Generally, a fluid pressure cylinder causes a piston, which is disposed in the interior of a cylinder main body, to be displaced along axial directions through the action of a pressure fluid that is supplied from a pressure fluid port, whereby transport, positioning, or the like of workpieces is carried out through a piston rod connected to one end side of the piston.

In relation to this type of cylinder, recently, there has been a demand to minimize the scale of the fluid pressure cylinder, and in particular, to shorten the length (total length of the fluid pressure cylinder) in the axial direction, under a condition in which the stroke length of the piston (piston rod) is maintained.

Responsive to such demands in the art, the present applicant has proposed a fluid pressure cylinder in which the total length thereof is shortened while maintaining the stroke length of the fluid pressure cylinder, by blocking an opening of the cylinder main body with a substantially planar cap, and abutting the piston against the cap when the piston reaches a displacement terminal end position (see Japanese Laid-Open Patent Publication No. 2005-240936).

As shown in FIG. 11, in such a fluid pressure cylinder, a stepped portion 3 is provided by carrying out a step-forming process on an end surface of the piston 2 that confronts the cap 1. Owing thereto, when the piston 2 comes into abutment against the cap 1, a space (air passage) S2 is formed through which the pressure fluid can be introduced between the cap 1 and the piston 2.

SUMMARY OF THE INVENTION

The present invention has an object of providing a fluid pressure cylinder in which a space into which a pressure fluid can be introduced is formed in the interior of a cylinder main body, without providing a stepped portion on an end surface of the piston or an end surface of the cap, while in addition, the total length of the fluid pressure cylinder can be shortened while maintaining the stroke length of the piston, thus further promoting and contributing to downsizing of the fluid pressure cylinder.

To achieve the foregoing object, the present invention is a fluid pressure cylinder, comprising:

a cylinder main body having therein a cylinder chamber into which a pressure fluid is introduced;

a piston connected to a piston rod, the piston being displaceable in an interior of the cylinder chamber along axial directions of the cylinder main body;

a cap for blocking one open end of the cylinder chamber disposed in the cylinder main body; and a rod end that blocks another open end of the cylinder chamber, wherein:

in the vicinity of the one open end of the cylinder chamber, a first pressure fluid inlet/outlet port is provided that communicates with the cylinder chamber in the cylinder main body;

in the vicinity of the other open end of the cylinder chamber, a second pressure fluid inlet/outlet port is provided that communicates with the cylinder chamber in the cylinder main body; and the cap comprising:

a planar main body portion against which an end surface of the piston abuts; and an outer edge portion provided on an outer circumference of the main body portion, the outer edge portion being bent from the main body portion toward the one open end of the cylinder chamber, and a distal end of the outer edge portion being locked with an inner circumferential wall of the cylinder chamber;

when the end surface of the piston comes into abutment against the main body portion, a space is formed, which is surrounded by the outer edge portion, the inner circumferential wall of the cylinder chamber, and the end surface of the piston; and the space communicates with the first pressure fluid inlet/outlet port.

According to the present invention, when the piston comes into abutment against the cap, even without providing a stepped portion on the end surface of the piston, a space can be formed through which the pressure fluid can be introduced into the interior of the cylinder chamber. Consequently, the length of the piston can be shortened by the widthwise dimension corresponding to the stepped portion, and the overall length of the fluid pressure cylinder can be made shorter. Together therewith, a fluid pressure cylinder of a more compact scale can be obtained.

Further, since a process for providing the stepped portion is rendered unnecessary, the number of manufacturing steps can be reduced. Thus, manufacturing costs can be reduced, and production efficiency can be improved accordingly.

Further, an outer edge portion constituting the cap is bent toward the open end of the cylinder chamber, and the distal end of the outer edge portion is locked with the inner circumferential wall of the cylinder chamber. Therefore, when the cap is pressed by the piston colliding therewith, due to the pressing force, the distal end of the outer edge portion is made to bite further into the inner circumferential wall of the cylinder chamber. As a result, the cap is capable of suitably absorbing shocks from the piston. Accordingly, compared to the conventional technique, a wall thickness of the cap, which is required to ensure the strength of the cap, can be made thin in the axial direction, and as a result, the overall length of the fluid pressure cylinder can be made shorter.

Further, an end surface that faces toward the cap may be provided in a planar shape perpendicular to the axial direction of the cylinder main body.

In accordance with the above structure, since the cap can support shocks due to abutment of the piston by the total main body portion of the cap having the planar end surface, the cap is further capable of suitably absorbing shocks that are imparted from the piston. Accordingly, compared to the conventional technique, the wall thickness of the cap, which is required to ensure the strength of the cap, can be made still thinner in the axial direction, and as a result, the overall length of the fluid pressure cylinder can be made shorter.

Further, the space into which a pressure fluid can be introduced may be formed in an annular shape with a triangular shape in cross section.

In accordance with the above structure, even in the event that the piston is rotated in a circumferential direction in the cylinder chamber, the space, which is surrounded by the outer edge portion of the cap, the inner circumferential wall of the cylinder chamber, and the end surface of the piston, and the first pressure fluid inlet/outlet port can always be kept in communication. Accordingly, the pressure fluid can reliably be supplied in order to apply a pressing force to the end surface of the piston.

Still further, a totality of a narrow-diameter distal end of the first pressure fluid inlet/outlet port may face toward the space that is formed in an annular shape with a triangular shape in cross section.

In accordance with the above structure, irrespective of the position of the piston in the cylinder chamber, the space, which is surrounded by the outer edge portion of the cap, the inner circumferential wall of the cylinder chamber, and the end surface of the piston, and the first pressure fluid inlet/outlet port can always be kept in communication. Accordingly, the pressure fluid can reliably be supplied to the end surface of the piston, and the piston can be moved smoothly in a reciprocating manner.

According to the present invention, the following advantages and effects can be obtained.

More specifically, by means of a simple structure, when the piston comes into abutment against the cap, a space (air passage) can be formed, which enables the pressure fluid to be introduced into the cylinder chamber. Accordingly, there is no need to carry out a process to provide a stepped portion on the end surface of the piston or the end surface of the cap, whereby the length of the piston or the cap in the axial direction can be made shorter by a widthwise dimension corresponding to the thickness of the stepped portion. As a result, the overall length of the fluid pressure cylinder can be made shorter, and together therewith, a fluid pressure cylinder of a more compact scale can be obtained.

The above and other objects features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENTS

Figure 1:
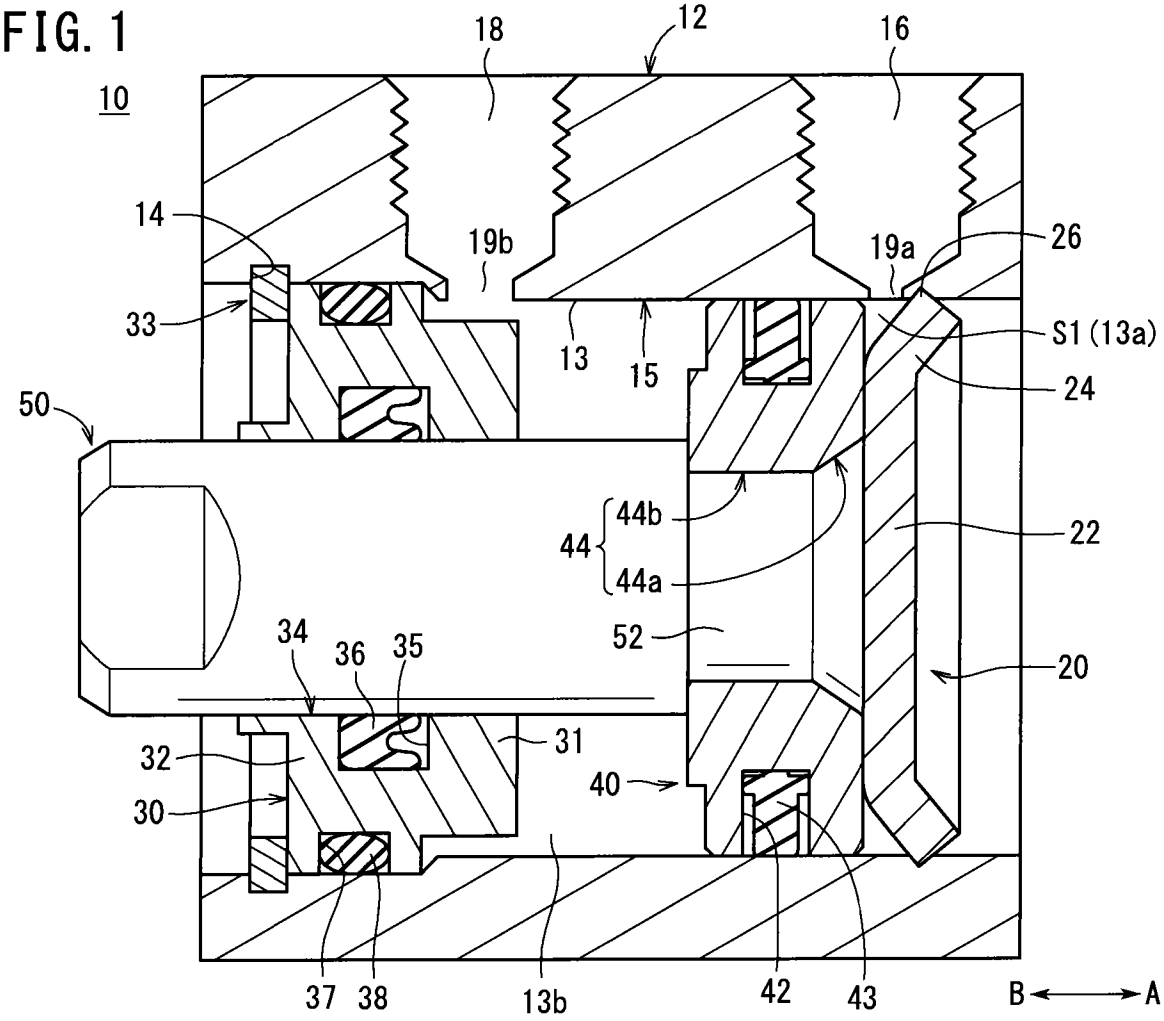
FIG. 1 is a vertical cross sectional view of a fluid pressure cylinder according to an embodiment of the present invention.

A preferred embodiment of a fluid pressure cylinder according to the present invention will be described in detail below with reference to the accompanying drawings. In FIG. 1, reference numeral 10 indicates a fluid pressure cylinder according to an embodiment of the present invention.

As shown in FIG. 1, the fluid pressure cylinder 10 is constituted from a cylinder tube (cylinder main body) 12 having a first port (first pressure fluid inlet/outlet port) 16 and a second port (second pressure fluid inlet/outlet port) 18 through which a pressure fluid (e.g., compressed air) is supplied and discharged, a plate-shaped (planar) cap 20 that blocks one opening (open end) of the cylinder tube 12, a rod end 30 that blocks another opening (open end) of the cylinder tube 12, a piston 40 that is disposed for displacement along axial directions in the interior of the cylinder tube 12, and a piston rod 50 connected to one end of the piston 40.

The cylinder tube 12 is formed in a cylindrical shape from a metal material such as aluminum or the like. The first port 16 is formed on an outer circumferential surface of one end side (in the direction of the arrow A) of the cylinder tube 12, and the second port 18 is formed on an outer circumferential surface of another end side (in the direction of the arrow B) separated a predetermined distance from the first port 16. Additionally, the first port 16 and the second port 18 communicate respectively with a cylinder chamber 13, which is formed in the interior of the cylinder tube 12, through a first communication passage 19*a* and a second communication passage 19*b*.

Figure 2:
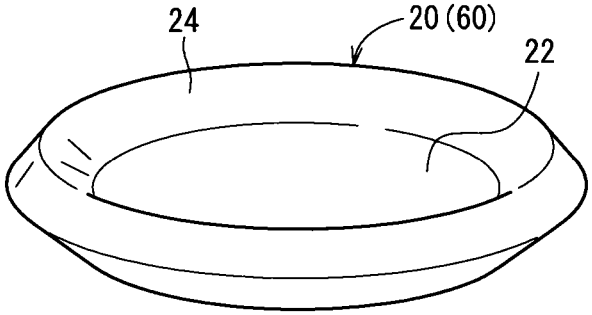
FIG. 2 is an exterior perspective view of an individual cap body shown in FIG. 1.
Figure 3:
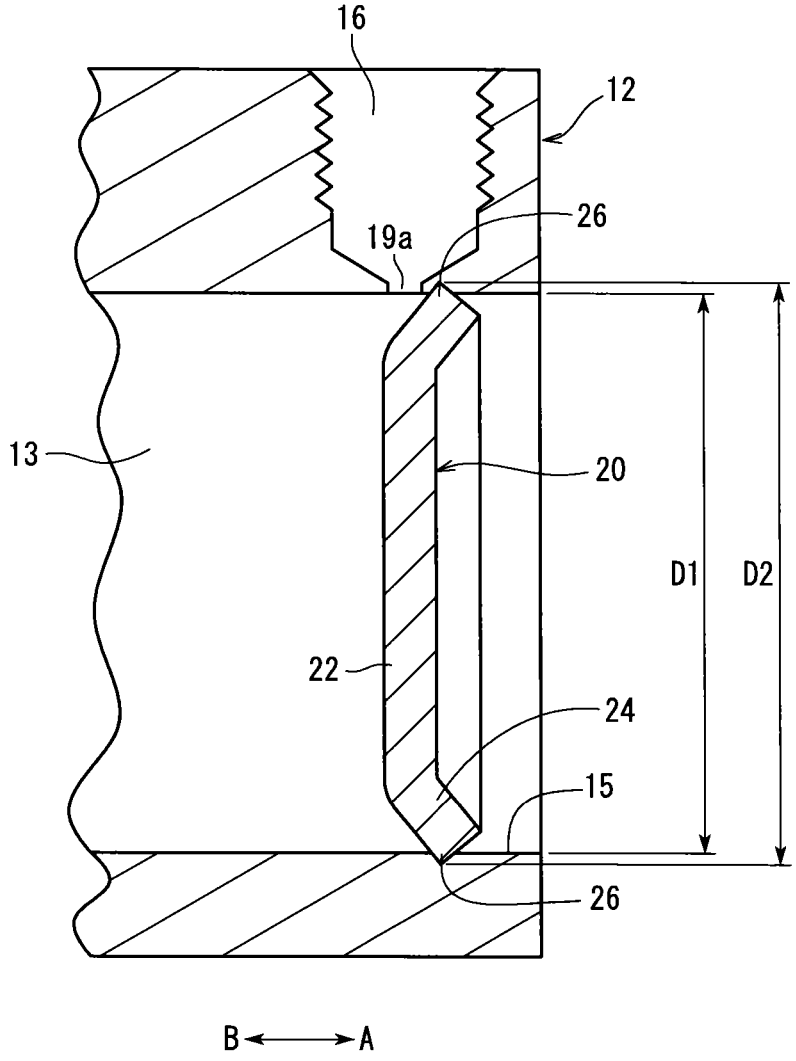
FIG. 3 is a partially enlarged cross sectional view in the vicinity of the cap in the fluid pressure cylinder shown in FIG. 1.

As shown in FIG. 2, the cap 20 is formed, for example, by pressing a plate 60 made from a metal material such as aluminum or the like, and is made up from a disk-shaped main body portion 22, and an outer edge portion 24, in which the outer circumference of the main body portion 22 is bent a predetermined angle toward the axis and is expanded in a radial outward direction. Additionally, as shown in FIG. 3, the outer edge portion 24 of the cap 20 is arranged to confront the one opening (in the direction of the arrow A) of the cylinder tube 12, and more specifically, to face toward a side opposite from the rod end 30.

Further, the outer diameter D2 of the outer edge portion 24 of the cap 20 is set to be slightly greater than the inner diameter D1 of the cylinder chamber 13. More specifically, when the cap 20 is mounted in the one opening of the cylinder tube 12, the outer edge portion 24 of the cap 20 is installed so as to bite into an inner circumferential wall 15 of the one opening. In greater detail, a distal end 26 of the outer circumferential side that constitutes the outer edge portion 24 bites a predetermined depth into the inner circumferential wall 15 of the cylinder tube 12, whereby the cap 20 is fixed securely in the interior of the one opening.

Further, the cap 20 is formed, for example, from a metal material in the same manner as the cylinder tube 12. In addition, the hardness E1 of the cap 20 is set to be greater than the hardness E2 of the cylinder tube 12 (E1>E2).

Furthermore, a surface treatment, such as an alumite treatment (i.e., anodic oxidation coatings on aluminum and aluminum alloy) or the like, is implemented on the cap 20. The thickness of the treated layer formed by the surface treatment is set, for example, roughly between 5 and 30 μm. Moreover, the surface treatment carried out with respect to the cap 20 is not limited to the aforementioned alumite treatment, and may, for example, be a chromate treatment or a coating.

As shown in FIG. 1, the rod end 30 includes a small diameter portion 31 and a large diameter portion 32 adjacent thereto. The small diameter portion 31 is arranged in the cylinder tube 12 on the side of the cap 20 (in the direction of the arrow A). In addition, a snap ring 33 is installed in a first annular groove 14 formed in the inner circumferential wall 15 of the cylinder chamber 13, such that the snap ring 33 abuts against an end surface of the large diameter portion 32, and the rod end 30 is fixed in a state of being positioned in the interior of the cylinder chamber 13.

In a central part of the rod end 30, a rod hole 34 is formed that penetrates therethrough in the axial direction (the direction of arrows A and B), and the piston rod 50 is inserted through the rod hole 34. A second annular groove 35 also is formed in the rod end 30, which is expanded in diameter from the rod hole 34, with a rod packing 36 being installed in the second annular groove 35. The rod packing 36 abuts against the outer circumferential side of the piston rod 50, thereby maintaining an airtight condition in the interior of the cylinder chamber 13. Further, an o-ring 38 is installed through a third annular groove 37 on the outer circumferential surface of the large diameter portion 32 of the rod end 30.

The piston 40 is disposed in the interior of the cylinder tube 12 and is displaceable along the axial directions. On the outer circumferential surface of the piston 40, a piston packing 43 is installed via a fourth annular groove 42. By way of the piston packing 43, the cylinder chamber 13 is divided into a cap-side cylinder chamber 13*a* and a rod-end-side cylinder chamber 13*b*.

Further, inside the piston 40, a piston hole 44 is formed that penetrates through the piston 40 in the axial direction (the direction of arrows A and B), and a connecting section 52 of the piston rod 50 is inserted through the piston hole 44. The piston hole 44 includes a cap-side piston hole 44*a*, which opens in a tapered shape expanding in diameter toward the side of the cap 20 (in the direction of the arrow A), and a rod-end-side piston hole 44*b* that communicates with the cap-side piston hole 44*a*, and opens at the same diameter toward the side of the rod end 30 (in the direction of the arrow B). The connecting section 52 of the piston rod 50, after being inserted through the rod-end-side piston hole 44*b*, is deformed plastically so as to block the cap-side piston hole 44*a*, and is formed in a planar shape perpendicular to the axial direction of the cylinder main body 12. Owing thereto, the end surface of the piston 40 that faces the cap 20 also is formed in a planar shape perpendicular to the axial direction of the cylinder main body 12.

According to the present embodiment, when the end surface of the piston 40 that faces the cap 20 abuts against the main body portion 22 of the cap 20, a small space (air passage) S1 is formed, which is surrounded by the outer edge portion 24 of the cap 20, the inner circumferential wall 15 of the cylinder chamber 13, and the end surface of the piston 40, i.e., a small space (air passage) S1 through which the pressure fluid can be introduced into the cylinder chamber 13.

The space S1 communicates with the first port 16 through the first communication passage 19*a*.

Further, as shown in FIG. 1, the space S1 is formed in an annular shape with a triangular shape in cross section. Therefore, even in the event that the piston 40 is rotated in a circumferential direction in the interior of the cylinder chamber 13, the space S1 is continually kept in communication with the first port 16. Accordingly, the pressure fluid can reliably be supplied in order to apply a pressing force to the end surface of the piston 40.

Furthermore, the first communication passage 19*a* is formed with a narrower diameter than the opening of the first port 16 provided on the outer circumference of the cylinder tube 12, such that the totality of the opening (distal end) of the first communication passage 19*a* is disposed in facing relation to the space S1. More specifically, the diameter of the opening (distal end) of the first communication passage 19*a* is formed to be shorter than one side of the space S1 having a triangular shape in cross section, on the inner circumferential wall 15 of the cylinder chamber 13. Owing to this structure, the pressure fluid is supplied reliably to the end surface of the piston 40, such that reciprocating motion of the piston 40 can be carried out.

The fluid pressure cylinder 10 according to the embodiment of the present invention is constructed basically as described above. Next, an assembly process by which the cap 20 is assembled onto the cylinder tube (cylinder main body) 12 will be described with reference to FIGS. 7A and 7B.

First, in a state in which the piston 40 and the piston rod 50 are not inserted through the cylinder chamber 13 in the interior of the cylinder tube 12, the cylinder tube 12 is set in position in a preparatory state, such that the opening on the one end of the cylinder tube 12 is oriented upwardly.

In such a preparatory state, a first punch (forming jig) 70 is inserted into the cylinder chamber 13 from the other opening, i.e., from the lower side, of the cylinder tube 12, such that an end of the first punch 70 is arranged at an installation position for the cap 20 in the cylinder chamber 13. The first punch 70 is constituted from a shaft, the end of which is formed in a planar shape, and the diameter of the first punch 70 is set to be slightly smaller than the inner diameter D1 of the cylinder chamber 13. At this time, the first punch 70 and the cylinder chamber 13 are disposed on the same axis, and the end surface of the first punch 70 is disposed substantially perpendicular to the axis of the cylinder chamber 13.

Next, the plate 60 that will become the base of the cap 20 is inserted from the side of the one opening, i.e. from the upper side, of the cylinder chamber 13. The plate 60 is formed with a curved shape in cross section and has a substantially constant thickness. Also, the outer diameter of the plate 60 is formed to be of substantially the same diameter or slightly smaller than the inner circumferential diameter D1 of the cylinder chamber 13.

Stated otherwise, the cross sectional area of the plate 60 is set to be at least substantially equal to or smaller than the cross sectional area of the cylinder chamber 13.

In addition, the plate 60 is inserted into the cylinder chamber 13 such that the bulging central portion thereof is oriented downward, and the plate 60 is in a state of being mounted on the end surface of the first punch 70. Since the outer diameter of the plate 60 is substantially the same or slightly smaller than the inner diameter D1 of the cylinder chamber 13, the plate 60 is inserted into the cylinder chamber 13 without contacting the inner circumferential wall 15 of the cylinder chamber 13. Accordingly, damage to the inner circumferential wall 15 caused by the plate 60 is avoided.

Lastly, a second punch (forming jig) 80, the distal end of which is formed with a tapered shape 81, is inserted from the side of the one opening, i.e., from the upper side, of the cylinder chamber 13, and is made to descend at a predetermined pressure. Similar to the first punch 70, the second punch 80 is made up from a shaft having a planar lower end surface, and the diameter of the lower end surface is set to be smaller than the diameter of the first punch 70.

Figure 7B:
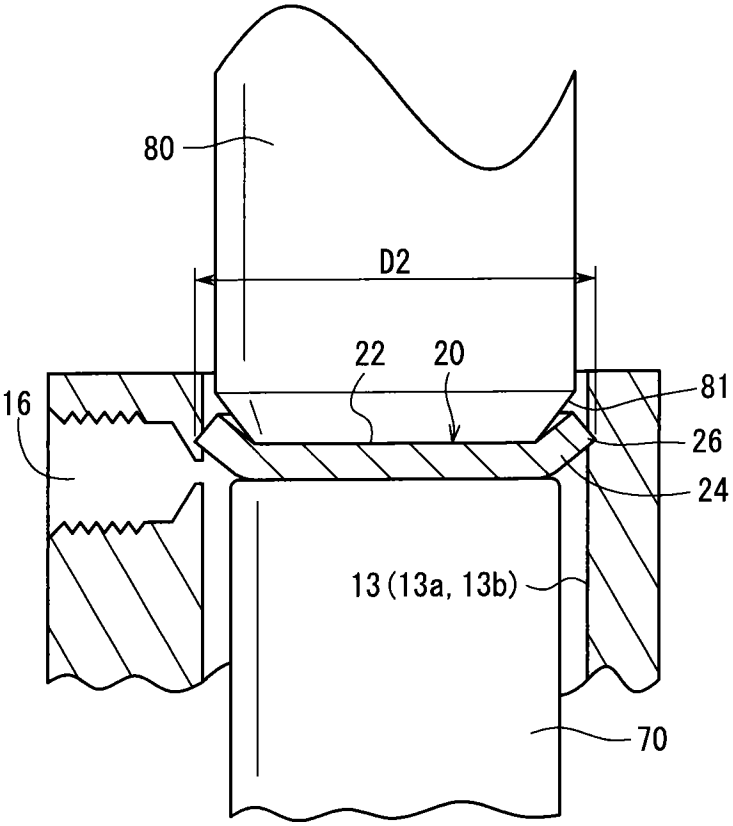
FIG. 7B is a partially enlarged cross sectional view showing a condition in which the plate is expanded in diameter by the first punch and the second punch to thereby form the cap.
Figure 7A:
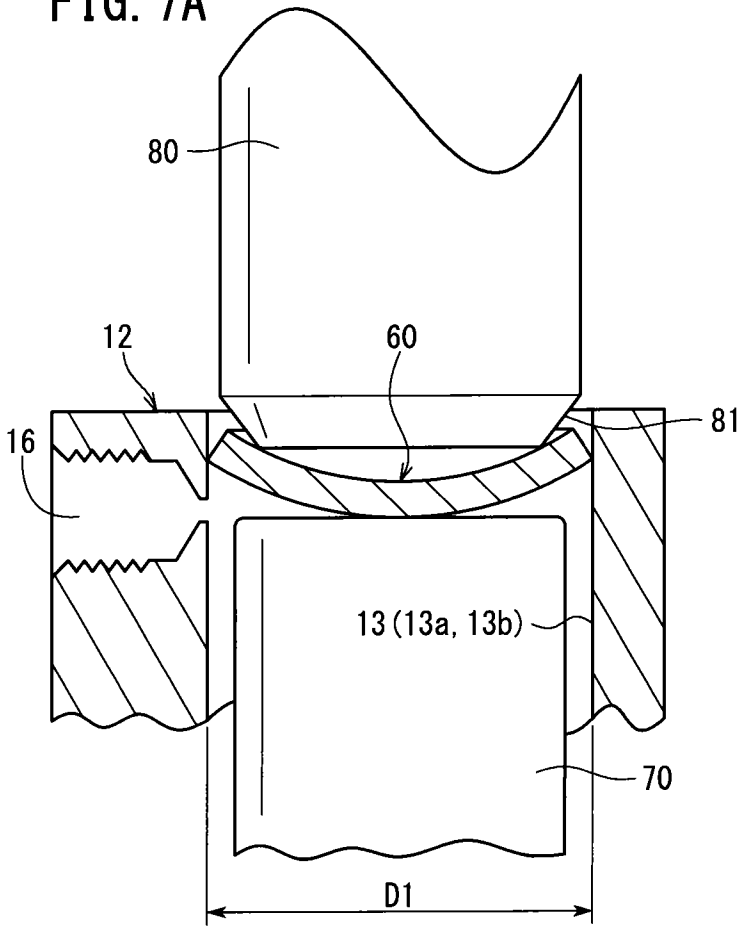
FIG. 7A is a partially enlarged cross sectional view showing a condition in which a plate is inserted into a cylinder chamber and is arranged between a first punch and a second punch, according to the present invention.

In addition, by lowering of the second punch 80, the plate 60 is gripped and pressed between the end surface of the second punch 80 and the end surface of the first punch 70. As a result of such a pressing force, as shown in FIG. 7B, the planar shaped main body portion 22 is formed between the first punch 70 and the second punch 80, and the outer circumferential portion of the plate 60 is bent upwardly under the action of the tapered shape 81, to thereby form the outer edge portion 24 of the cap 20. Stated otherwise, the region of the plate 60 that is gripped by the first punch 70 and the second punch 80 becomes the planar main body portion 22, and further, the outer circumferential portion of the main body portion 22, i.e., the region that is expanded diametrically in a radial outward direction and is plastically deformed upwardly, becomes the outer edge portion 24, whereby the plate 60 is made into the cap 20.

At this time, as a result of the outer edge portion 24 being expanded in a radial outward direction and plastically deformed in an upward direction, the outer diameter D2 of the outer edge portion 24 of the cap 20 becomes greater than the inner diameter D1 of the cylinder chamber 13 (D2>D1). Owing thereto, the distal end 26 of the outer edge portion 24 bites into and locks with respect to the inner circumferential wall 15 of the cylinder chamber 13, whereby the cap 20 is fixed with respect to the cylinder tube 12.

As a result of the cap 20 being assembled in this manner with respect to the cylinder tube (cylinder main body) 12, when the end surface of the piston 40 comes into abutment against the main body portion 22 of the cap 20, the space (air passage) S1, through which the pressure fluid can be introduced into the cylinder chamber 13, is formed by the outer edge portion 24 of the cap 20, the inner circumferential wall 15 of the cylinder chamber 13, and the end surface of the piston 40 (see FIG. 1). More specifically, without carrying out a process to form a stepped portion, the small space (air passage) S1 can be formed through which the pressure fluid can be introduced into the cylinder chamber 13. Consequently, due to the fact that a width dimension corresponding to the stepped portion is eliminated, the length in the axial direction of the piston 40 or the cap 20 can be shortened, and the total length of the fluid pressure cylinder 10 can also be made shorter.

In addition, because a step-forming process is rendered unnecessary, the number of manufacturing steps can be reduced. Accordingly, improvement of production efficiency and reduction of manufacturing costs can be achieved.

Further, the outer edge portion 24 constituting the cap 20 is bent toward the open end of the cylinder chamber 13, and the distal end 26 of the outer edge portion 24 engages and locks with the inner circumferential wall 15 of the cylinder chamber 13. Therefore, when the cap 20 is pressed by the piston 40 and collides therewith, due to the pressing force, the distal end 26 of the outer edge portion 24 is made to bite further into the inner circumferential wall 15 of the cylinder chamber 13. As a result, the cap 20 is capable of suitably absorbing shocks from the piston 40. Accordingly, compared to the conventional technique, the wall thickness of the cap 20, which is required to assure the strength thereof, can be made thinner in the axial direction, and as a result, the overall length of the fluid pressure cylinder 10 can be made shorter without the need for reducing the stroke.

Still further, because the plate 60 is formed with an outer diameter that is slightly smaller than the inner diameter D1 of the cylinder chamber 13, the plate 60 can be inserted into the cylinder chamber 13 without sliding against the inner circumferential wall 15 of the cylinder chamber 13. Owing thereto, upon insertion of the plate 60, no damage is caused to the inner circumferential wall 15 as a result of the plate 60, and the occurrence of minor leakage of the pressure fluid through such a damaged area can favorably be avoided.

Furthermore, since the cap 20 can be fixed in a desired position along the axial direction of the cylinder chamber 13, a locking ring for the purpose of fixing the cap, which has been utilized in the fluid pressure cylinder according to the conventional technique, a groove for installation of the locking ring, and an o-ring disposed on the outer circumferential surface of the cap are rendered unnecessary. Thus, manufacturing costs and the number of component parts of the fluid pressure cylinder 10 can be reduced, and production efficiency can be improved.

Furthermore, because the outer edge portion 24 of the cap 20 is arranged to face toward a side opposite from the cylinder chamber 13, even in the event that a pressing force of the piston 40 is applied with respect to the cap 20, or if pressure of the pressure fluid inside the cylinder chamber 13 is applied thereto and the cap 20 is pressed in a direction away from the cylinder chamber 13, the distal end 26 of the outer edge portion 24 is made to bite further into the inner circumferential wall 15 of the cylinder chamber 13 by means of the aforementioned pressure. Consequently, disengagement of the cap 20 from the cylinder tube 12 can reliably be prevented. More specifically, the outer edge portion 24 performs a retaining function to prevent disengagement of the cap 20.

Still further, because a surface treatment is performed on the cap 20, owing to the surface treatment, coating, or the like, the cap 20 can be kept in intimate contact with respect to the inner circumferential wall 15 of the cylinder chamber 13 in the cylinder tube 12. As a result, minute leakage of pressure fluid between the cap 20 and the cylinder chamber 13 of the cylinder tube 12 can reliably be prevented.

Further, because the cap 20 and the cylinder tube 12 are formed from the same material, they have the same coefficient of thermal expansion, and also the same volumetric expansion ratio due to changes in temperature. Owing thereto, even in the event that the fluid pressure cylinder 10 is subjected to changes in temperature, gaps are not formed between the cylinder tube 12 and the cap 20. As a result, leakage of pressure fluid caused by changes in temperature can reliably be prevented. Moreover, since the cap 20 and the cylinder tube 12 can be adhered to each other, minute leakage of pressure fluid passing between the cap 20 and the cylinder tube 12 can reliably be prevented.

Further, since the hardness E1 of the cap 20 is set to be greater than the hardness E2 of the cylinder tube 12 (E1>E2), the cap 20 can be installed while being made to bite into the inner circumferential wall 15 of the cylinder chamber 13. As a result, the cap 20 is reliably and strongly fixed with respect to the cylinder tube 12.

Further, both the cylinder tube 12 and the cap 20 are formed from aluminum, and therefore, after the cap 20 has been mounted with respect to the cylinder tube 12, a surface treatment such as an alumite treatment or the like can be carried out integrally on the cylinder tube 12 and the cap 20. As a result, upon performing the surface treatment, the treatment agent enters and penetrates between the cap 20 and the cylinder tube 12, whereby any small gaps therebetween are sealed. Thus, minute leakage of pressure fluid can be prevented, and the number of manufacturing steps can be reduced.

Furthermore, because the cap 20 is formed from a plate shaped metal material, even in the case that the piston 40 comes into abutment with respect to the cap 20 and is stopped thereby, since upon abutment thereof the cap 20 is elastically deformed, shocks imparted from the piston 40 can suitably be buffered.

The fluid pressure cylinder 10 according to the embodiment of the present invention is constructed basically as described above. Next, operations of the fluid pressure cylinder 10 will be explained.

Figure 4:
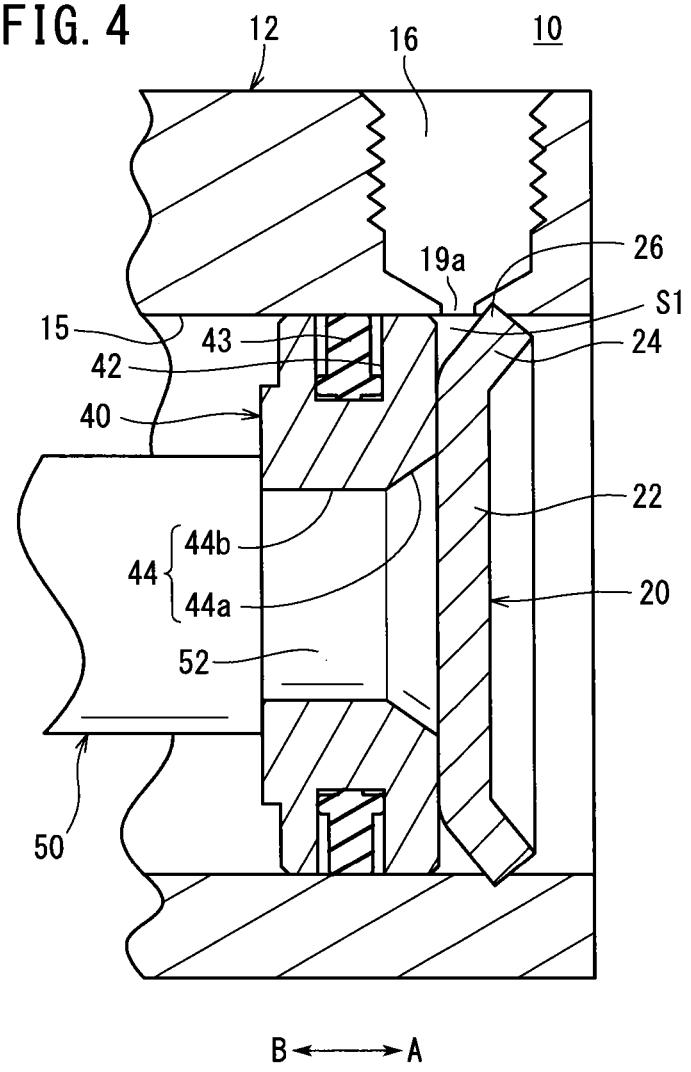
FIG. 4 is a partially enlarged cross sectional view showing a condition, in the vicinity of the cap of FIG. 1, in which the piston and the cap are in mutual abutment.

As shown in FIG. 4, a state in which the piston 40 abuts against the cap 20, and is in intimate contact with the cap 20 owing to grease (not shown) that is coated on respective end surfaces of the cap 20 and the piston 40, will be described as an initial position.

First, in the initial position, a pressure fluid is introduced to the first port 16 from a non-illustrated pressure fluid supply source. In this case, the second port 18 is placed in a state of being open to atmosphere through operation of a non-illustrated switching valve.

The pressure fluid, which is supplied to the first port 16, is introduced to the interior of the cylinder chamber 13 through the first communication passage 19*a*. In greater detail, the pressure fluid is introduced into the space (air passage) S1 which is formed by the outer edge portion 24 of the cap 20, the inner circumferential wall 15 of the cylinder chamber 13, and the end surface of the piston 40.

Figure 5:
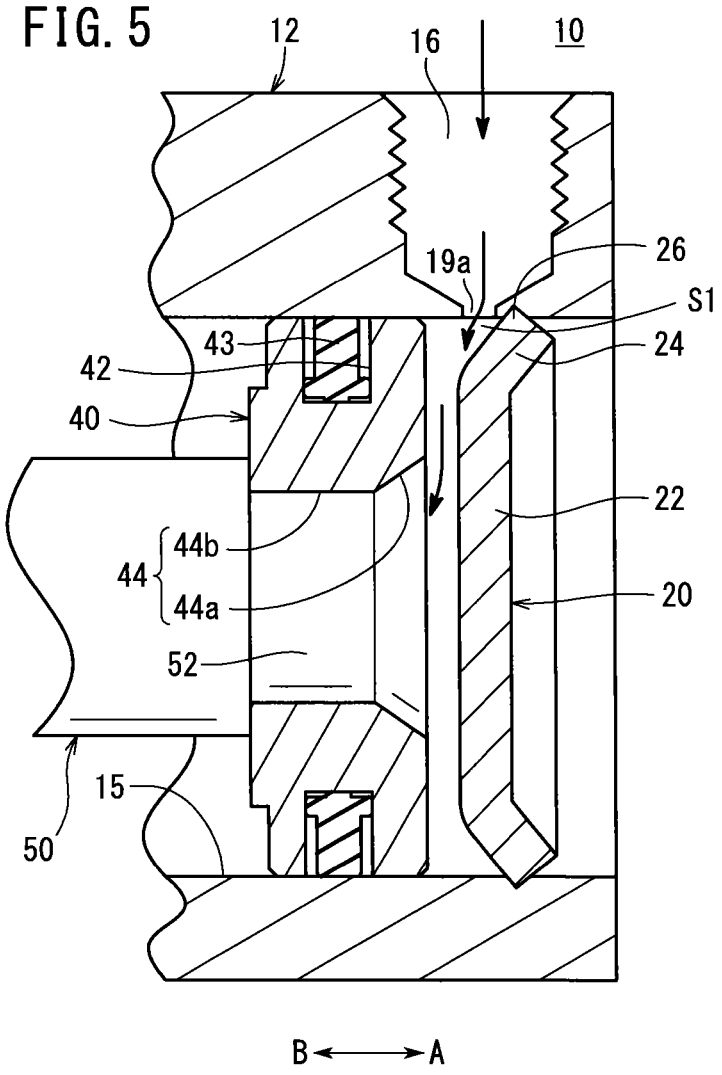
FIG. 5 is a partially enlarged cross sectional view showing a condition, in the vicinity of the cap of FIG. 1, in which the piston and the cap are slightly separated.

Next, as shown in FIG. 5, the pressure fluid introduced to the space (air passage) S1 applies pressure to the end surface of the piston 40 toward the side of the rod end 30 (in the direction of the arrow B). As a result, the piston 40, which was in intimate contact through grease with the main body portion 22 of the cap 20, is displaced in a direction away from the cap 20, and more specifically toward the side of the rod end 30 (in the direction of the arrow B).

Upon the piston 40 separating away from the main body portion 22 of the cap 20, the pressure fluid presses further on the end surface of the piston 40.

Figure 6:
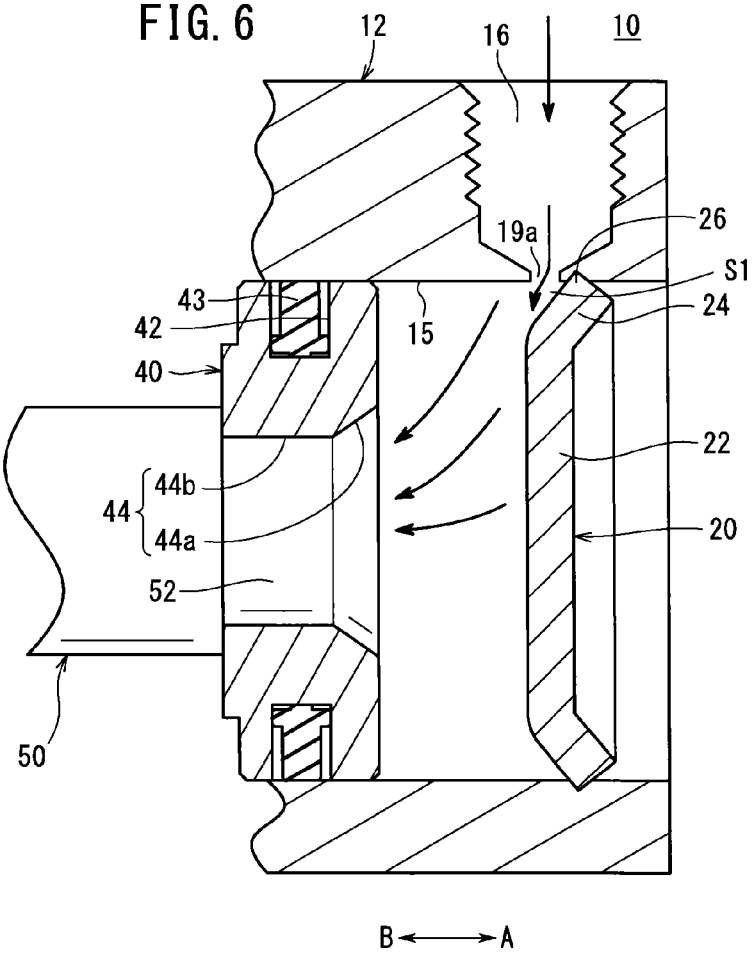
FIG. 6 is a partially enlarged cross sectional view, in the vicinity of the cap of FIG. 1, showing a condition in which the piston and the cap are separated from each other.

Consequently, as shown in FIG. 6, the piston 40 is displaced together with the piston rod 50 further in a direction (the direction of the arrow B) away from the cap 20. Thus, the piston rod 50 is made to project outwardly gradually with respect to the rod end 30, and the end surface of the piston 40, which faces toward the rod end 30, reaches a displacement terminal end position upon abutment thereof against the end surface of the rod end 30.

Next, in the event that the piston 40 is restored to the initial position from the aforementioned displacement terminal end position, the pressure fluid, which had been supplied to the first port 16, is supplied to the second port 18 through a non-illustrated switching device. As a result of the pressure fluid being supplied to the cylinder chamber 13 through the second communication passage 19*b*, the piston 40 is pressed gradually in a direction (the direction of the arrow A) to separate away from the rod end 30. In this case, the first port 16 is in a state of being open to atmosphere.

In addition, together with displacement of the piston 40, the piston rod 50 is displaced so as to gradually enter the inside of the rod end 30. The piston 40 is restored to the initial position upon abutment thereof against the cap 20, whereupon supply of the pressure fluid is halted.

Figure 8B:
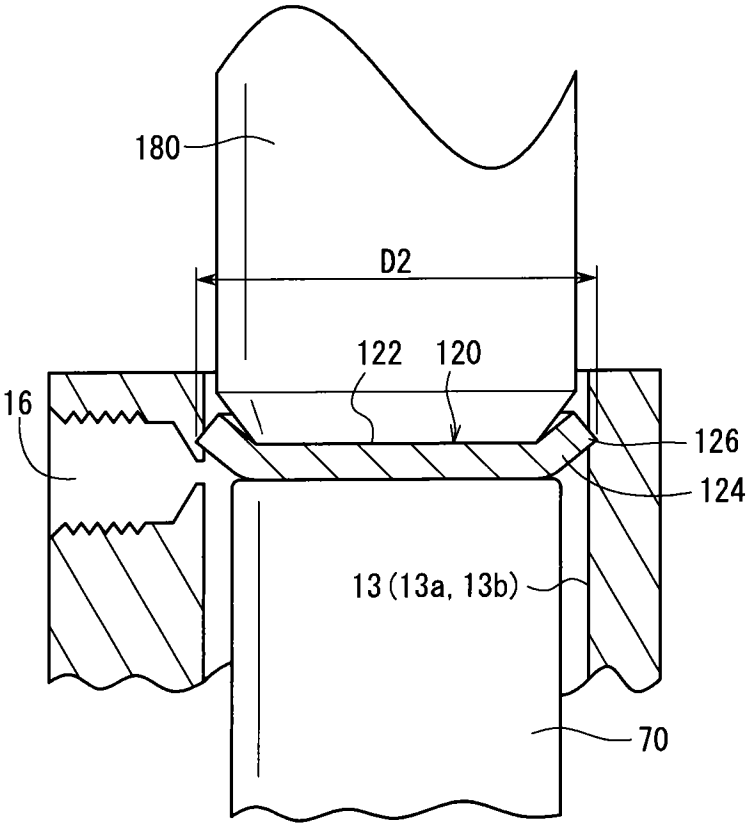
FIG. 8B is an enlarged cross sectional view showing a condition in which the plate is expanded in diameter by the first punch and the third punch to thereby form the cap.
Figure 8A:
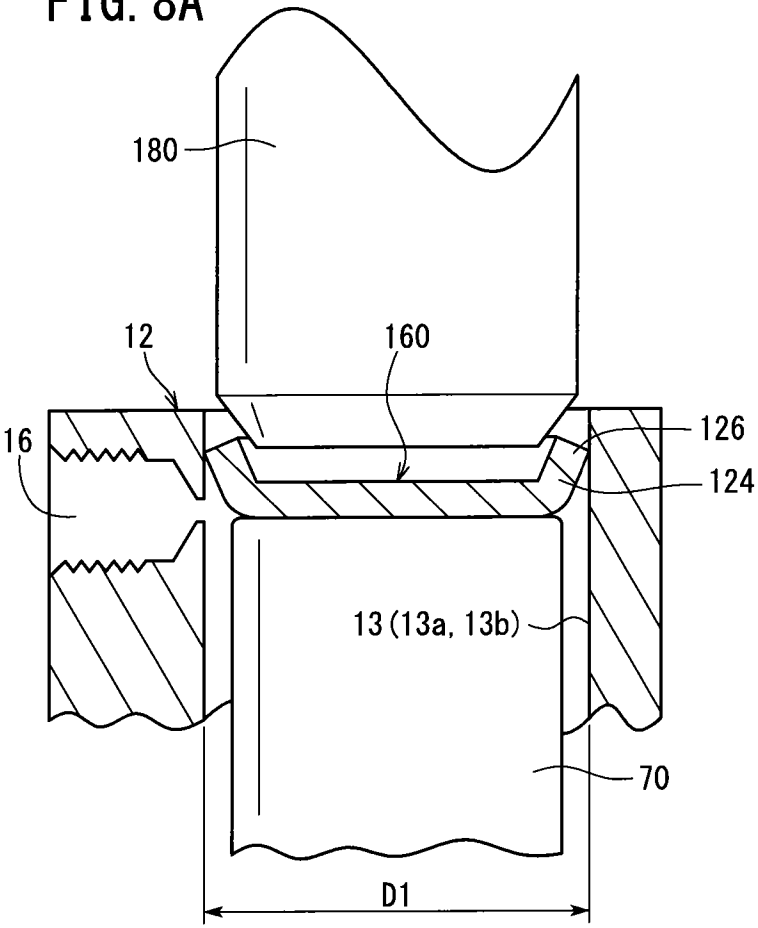
FIG. 8A is an enlarged cross sectional view showing a condition in which a plate is inserted into the cylinder chamber and is arranged between a first punch and a third punch, according to a first modification.

The plate 60 that forms the cap 20 is not limited to being formed with a curved shape in cross section as has been described above. For example, as shown in FIG. 8A, a plate 160 may be provided that includes an outer edge portion 124, the outer circumferential portion of which is bent upwardly beforehand. With respect to such a plate 160, formation of a cap 120 may be carried out using a third punch 180 that corresponds to the cross sectional shape of the plate 160 (see FIG. 8B).

In this case, since the main body portion 122 and the outer edge portion 124 are formed beforehand on the plate 160, the outer edge portion 124 on the cap 120 can be formed more reliably and with high precision. Further, when the cap 120 is installed in the interior of the cylinder chamber 13, the distal end 126 of the outer edge portion 124 bites reliably into the inner circumferential wall 15 of the cylinder chamber 13, and therefore the cap 120 can reliably and strongly be engaged and locked with respect to the cylinder tube 12.

Figure 9A:
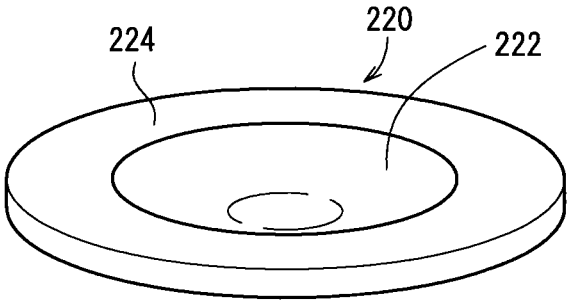
FIG. 9A is an exterior perspective view of a cap according to a second modification.
Figure 9B:
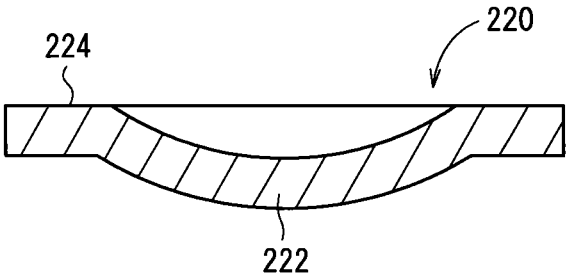
FIG. 9B is a cross sectional view of the cap.

Further, instead of the aforementioned cap 20 or the cap 120, as shown in FIGS. 9A and 9B, a cap 220 may be used including a main body portion 222 with a curved shape in cross section, and an outer edge portion 224, which is formed with a planar shape on the outer circumference of the main body portion 222.

With the cap 220 shown in FIGS. 9A and 9B, as a result of being press-formed by the first punch 70 and the second punch 80, the main body portion 222 thereof is plastically deformed in a planar shape, and then the main body portion 222 is subjected to plastic flow in a radial outward direction together with the outer edge portion 224. As a result, the cap 220 is formed in a planar shape overall, and the outer diameter thereof is expanded. Consequently, the outer edge portion 224 of the cap 220 bites into and engages perpendicularly with respect to the inner circumferential wall 15 of the cylinder chamber 13, and is then locked with the inner circumferential wall 15 thereof.

Figure 10:
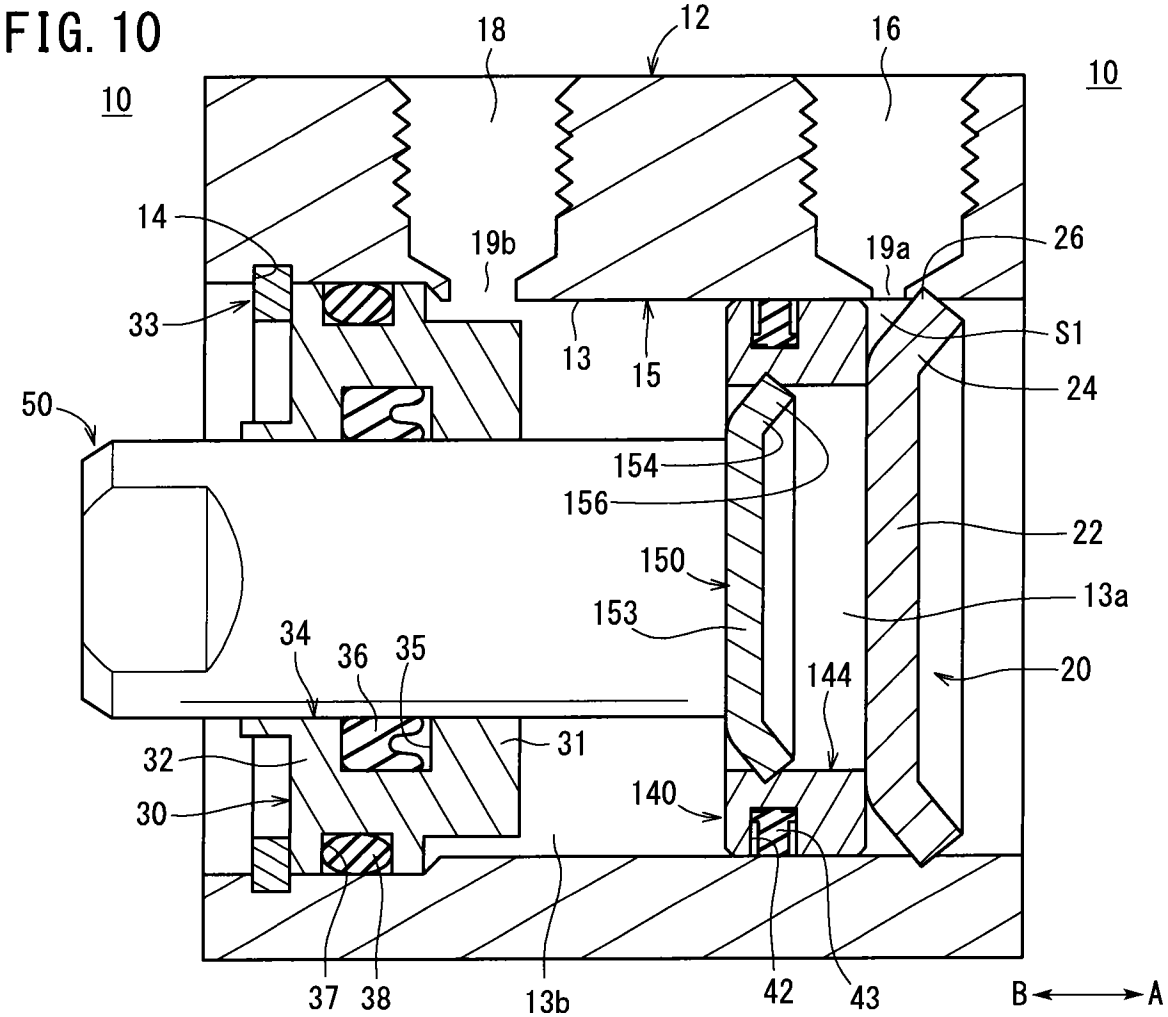
FIG. 10 is a vertical cross sectional view of a fluid pressure cylinder according to a third modification.
Figure 11:
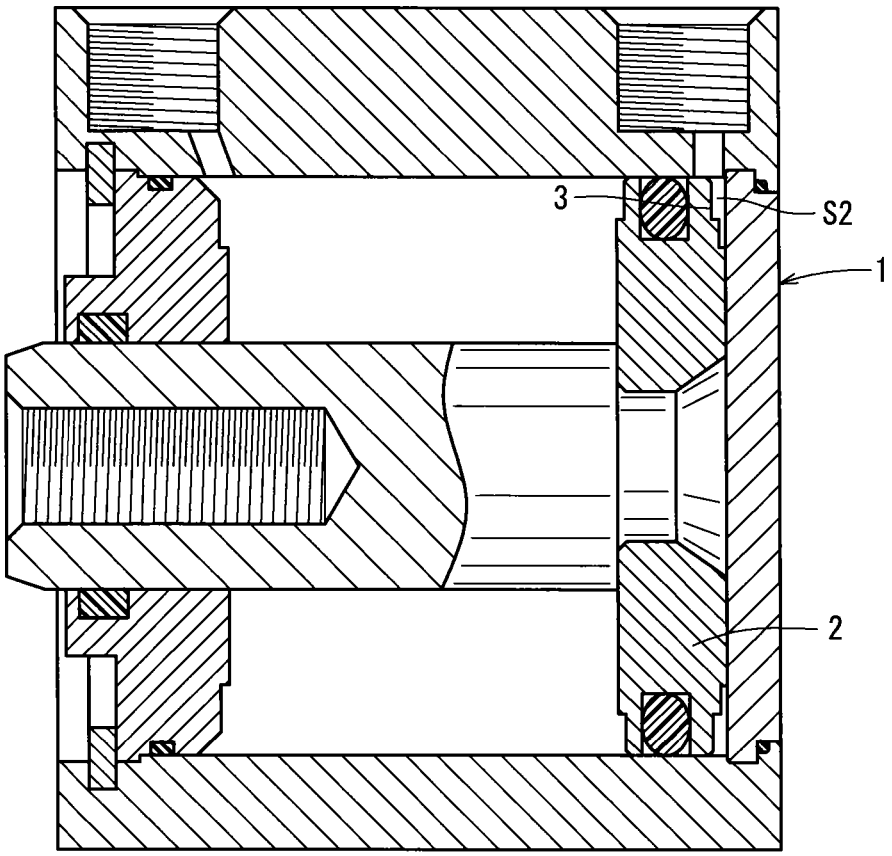
FIG. 11 PRIOR ART
FIG. 11 is a vertical cross sectional view of a fluid pressure cylinder according to Japanese Laid-Open Patent Publication No. 2005-240936.

Still further, in place of the above-described piston 40, as shown in FIG. 10, a piston 140 may be used in which a piston hole 144 is formed having a substantially constant diameter, and which penetrates through the piston 40 in the axial direction (the direction of arrows A and B).

A connecting body 150, which is connected to an end of the piston rod 50, is inserted in the piston hole 144. The connecting body 150 is formed, for example, by pressing a plate member made of a metal material such as stainless steel or the like, and is constituted from a disk-shaped main body portion 153, and an outer edge portion 154, in which the outer circumference of the main body portion 153 is bent a predetermined angle toward the axis and is expanded in diameter in a radial outward direction. The outer edge portion 154 of the connecting body 150 is arranged to face toward one opening (in the direction of the arrow A), and more specifically toward the side of the cap 20, of the cylinder tube 12.

The outside diameter of the outer edge portion 154 is set to be slightly greater than the inner diameter of the piston hole 144. Stated otherwise, the outer edge portion 154 of the connecting body 150 is installed so as to bite into the inner circumferential wall of the piston hole 144. More specifically, the distal end 156 of the outer circumferential side that makes up the outer edge portion 154 bites a predetermined depth into the inner circumferential wall of the piston hole 144, whereby the connecting body 150 is fixed in the interior of the piston hole 144.

When the piston 140 is displaced and comes into abutment against the cap 20, the connecting body 150 is deformed elastically, whereby shocks applied to the cap 20 are buffered. Accordingly, an advantage is brought about, in that, compared to using the piston 40, the wall thickness of the cap 20, which is required to assure the strength thereof, can be made thinner in the axial direction.

The cap and the fixing method therefor, which are used in the fluid pressure cylinder according to the present invention, are not limited to the embodiments described above, but various alternative or additional features and structures may be adopted without deviating from the essence and scope of the invention as set forth in the appended claims.

What is claimed is:

1. A fluid pressure cylinder comprising:

a cylinder main body having therein a cylinder chamber into which a pressure fluid may be introduced, the cylinder chamber having one open end in an axial direction of the cylinder main body and another open end opposite the one open end in the axial direction;

a piston connected to a piston rod, the piston being displaceable in an interior of the cylinder chamber along the axial direction;

a cap for blocking the one open end of the cylinder chamber, the cap comprising a planar main body portion, which an end surface of the displaceable piston can abut against or separate from, the planar main body portion being located at a first position in the axial direction of the cylinder main body, the cap further comprising an annular outer edge portion provided on an outer circumference of the main body portion, the annular outer edge portion being bent to extend in an oblique direction having a component in the axial direction extending toward the one open end of the cylinder chamber, away from the another open end of the cylinder chamber and away from the planar main body portion, the annular outer edge portion having a distal end that bites into an inner circumferential wall of the cylinder chamber, to be locked with the inner circumferential wall of the cylinder chamber, a position in the axial direction where a surface of the annular outer edge portion facing the another open end of the cylinder chamber bites into the inner circumferential wall of the cylinder chamber defining a second position wherein the second position is farther from the another open end, in the axial direction, than is the first position, and wherein a space which is delimited by the surface of the annular outer edge portion facing the another open end of the cylinder chamber, the inner circumferential wall of the cylinder chamber and the end surface of the piston is formed when the end surface of the piston comes into abutment against the main body portion;

a rod end that blocks the another open end of the cylinder chamber; and a first pressure fluid inlet/outlet port that communicates with the cylinder chamber in the cylinder main body, wherein the first pressure fluid inlet/outlet port opens to the cylinder chamber at a location in the axial direction between the first position and the second position, such that the first pressure fluid inlet/outlet port communicates with said space, wherein the space is formed in an annular shape with a triangular shape in cross section, wherein the space is provided between the first position and the second position, and wherein the second position is at a position in the axial direction that corresponds to a position in the axial direction of a corner of said triangular shape that is the farthest of the corners from said another open end.

2. The fluid pressure cylinder according to claim 1, wherein the portion of the end surface of the piston forming the space is located at the first position when the end surface of the piston comes into abutment against the main body portion.

3. The fluid pressure cylinder according to claim 1, wherein a totality of the first pressure fluid inlet/outlet port is provided between the first position and the second position.

4. The fluid pressure cylinder according to claim 1, wherein the space is provided entirely between the first position and the second position.

* * * * *